US006551419B2

(12) United States Patent
Kanisawa et al.

(10) Patent No.: US 6,551,419 B2
(45) Date of Patent: Apr. 22, 2003

(54) HOT-ROLLED STEEL WIRE AND ROD FOR MACHINE STRUCTURAL USE AND A METHOD FOR PRODUCING THE SAME

(75) Inventors: Hideo Kanisawa, Muroran (JP); Tatsuro Ochi, Muroran (JP); Manabu Kubota, Muroran (JP); Koji Tanabe, Muroran (JP); Kiichiro Tsuchida, Muroran (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/829,742

(22) Filed: Jul. 6, 2001

(65) Prior Publication Data

US 2003/0015264 A1 Jan. 23, 2003

(51) Int. Cl.[7] ..... C22C 38/02; C22C 38/04; C22C 38/14; C22C 38/12; C21D 8/06

(52) U.S. Cl. ..... 148/320; 148/332; 148/334; 148/335; 148/336; 148/330; 148/595; 148/598

(58) Field of Search ..... 148/595, 598, 148/320, 332, 334, 335, 336, 330

(56) References Cited

U.S. PATENT DOCUMENTS 3,892,602 A * 7/1975 Kranenberg ..... 148/320

FOREIGN PATENT DOCUMENTS

JP 40533967 A * 12/1993 ..... C22C/38/00

* cited by examiner

*Primary Examiner*—Deborah Yee
(74) *Attorney, Agent, or Firm*—Kenyon & Kenyon

(57) ABSTRACT

The present invention provides a hot rolled steel wire rod or bar for machine structural use having, in the as-hot-rolled condition, cold workability equal to that of the conventional wire rods or bars softened through annealing after hot rolling, and a method to produce the same: and relates to a hot rolled steel wire rod or bar for machine structural use, characterized in that; the wire rod or bar is made from a steel consisting of, in weight, 0.1 to 0.5% of C, 0.01 to 0.5% of Si, 0.3 to 1.5% of Mn, and the balance comprising Fe and unavoidable impurities and containing strengthening elements as required; its microstructure consists of ferrite and pearlite; its ferrite crystal grain size number defined under Japanese Industrial Standard (JIS) G 0552 is 11 or higher; and a granular carbide 2 $\mu$m or less in circle-equivalent diameter and having an aspect ratio of 3 or less accounts for a percentage area of 3 to 15%.

4 Claims, 4 Drawing Sheets

(×4000)

HOT-ROLLED STEEL WIRE AND ROD FOR MACHINE STRUCTURAL USE AND A METHOD FOR PRODUCING THE SAME

BACKGROUND OF THE INVENTION

1. Field of the Invention

This invention relates to a hot rolled steel wire rod or bar for machine structural use and a method of producing the same. More specifically, it relates to the use of a soft steel wire rod or bar easily workable by drawing, machining, cold forging and other cold working methods, in an as-rolled condition without softening, in manufacturing components for cars and construction machines and the like, and a method to produce the same.

2. Description of the Related Art

Components of cars and construction machines and the like have been conventionally manufactured by softening a hot rolled steel wire rod or bar to secure its cold workability, forming it by cold forging, drawing, machining and/or other cold working methods, then quenching and tempering the pieces thus formed.

When manufacturing bolts, as an example of machine components, from a hot rolled steel rod, the cold workability is secured by applying softening in the following manner: a low temperature annealing at about 650° C. for 5 hours in the case of stud bolts and the like, which require light cold working; a common annealing at about 700° C. for 7 hours in the case of hexagonal bolts and the like; and a spheroidizing annealing at about 720° C. for 20 hours in the case of flanged bolts and the like, which require heavy cold working.

As stated above, the softening process takes a long time and the cost of the annealing has come to account for a considerable portion in the total manufacturing costs of machine components and the like because of the recent rise in energy costs.

In this situation, various technologies to eliminate the softening process before the cold working have been proposed for enhancing productivity and saving energy such as the following: a production method of a low alloy steel excellent in cold workability disclosed in Japanese Unexamined Patent Publication No. S57-73123; a direct softening method of a steel wire or bar for a structure disclosed in Japanese Unexamined Patent Publication No. S58-58235; and a production method of a steel for machine structural use suitable for cold working disclosed in Japanese Unexamined Patent Publication No. H8-209236.

The cold workability of the steel wire rods or bars obtained by these production methods, as-hot-rolled, however, is insufficient compared with conventionally softened steel wire rods or bars and, thus, no soft steel wire rods or bars for machine structural use satisfactory for actual use in the as-hot-rolled condition have been obtained yet.

SUMMARY OF THE INVENTION

In view of the above situation, the object of the present invention is to provide an as-hot-rolled steel wire rod or bar for machine structural use having as good cold workability as the conventional steel wire rods or bars softened after hot rolling, and a method to produce the same.

The present inventors directed their attention to the structure of steel wire rods or bars obtained through a softening process and studied a method to secure cold workability by obtaining, in the as-hot-rolled condition, a structure equivalent to the one resulting from the softening.

FIG. 1 is a micrograph (×4,000) of a hot rolled CH45K steel wire rod after a common softening treatment (700° C.×3 h.). As seen in the figure, the microstructure of the steel consists of ferrite and lamellar pearlite, and tabular cementite in the lamellar pearlite is partially cut into fragments. The softening of the steel is caused by a prescribed percentage of ferrite in its structure and the fragmentation of the cementite in the lamellar pearlite, and the cold workability of the steel wire rod is thus secured.

The present inventors discovered that steel wire rods or bars produced by hot rolling a billet, having a specific chemical composition at a low temperature and cooling in the temperature range from 700 to 650° C. at an ultra-low cooling rate, had a novel structure wherein ferrite accounted for a high percentage and the cementite in the lamellar pearlite was partially spheroidized, and that good cold workability was thus secured since the steel wire rods or bars were soft in the as-hot-rolled condition thanks to the novel structure; and established the present invention on the basis of the finding.

The gist of the present invention, therefore, is as follows:

(1) A hot rolled steel wire rod or bar for machine structural use, characterized in that: the wire rod or bar is made from a steel consisting of, in weight, 0.1 to 0.5% of C, 0.01 to 0.5% of Si, 0.3 to 1.5% of Mn, and the balance consisting of Fe and unavoidable impurities; its microstructure consists of ferrite and pearlite; its ferrite crystal grain size number defined under Japanese Industrial Standard (JIS) G 0552 is 11 or higher; and the granular carbide 2 $\mu$m or less in circle-equivalent diameter and having an aspect ratio of 3 or less accounts for a percentage area of 3 to 15%.

(2) A hot rolled steel wire rod or bar for machine structural use according to the item (1), characterized by further containing, in weight, one or more of;

0.2 to 2.0% of Cr, 0.1 to 1.0% of Mo, 0.3 to 1.5% of Ni, 1.0% or less of Cu, and 0.005% or less of B.

(3) A hot rolled steel wire rod or bar for machine structural use according to the item (1) or (2), characterized by further containing, in weight, one or more of;

0.005 to 0.04% of Ti, 0.005 to 0.1% of Nb, and 0.03 to 0.3% of V.

(4) A method to produce a hot rolled steel wire rod or bar for machine structural use, characterized by subjecting a steel having the chemical composition specified in any one of the items (1) to (3) to a rough hot rolling in a temperature range from 850 to below 1,000° C., a finish hot rolling in a temperature range from the $Ar_3$ transformation temperature to 150° C. above it and a cooling from 700 to 650° C. at a cooling rate of 0.02 to 0.3° C./sec., so that the steel may have a ferrite crystal grain size number defined under JIS G 0552 being 11 or higher and contain the granular carbide 2 $\mu$m or less in circle-equivalent diameter and having an aspect ratio of 3 or less account for a percentage area of 3 to 15%.

DESCRIPTION OF THE PREFERRED EMBODIMENTS

The present invention is described in detail hereafter.

Conventional hot rolled steel wire rods or bars have microstructures consisting of ferrite and lamellar pearlite and, therefore, their strength is high and it is difficult to process them by cold working in an as-hot-rolled condition. For this reason, in order to obtain machine components having prescribed strength, the wire rods or bars are softened before cold working and a heat-treatment for quenching and tempering is applied after the cold working.

The present invention enables cold working of a steel wire rod or bar in the as-hot-rolled condition by obtaining a steel wire rod or bar having the same strength as is obtainable through the softening in the as-hot-rolled state.

The present inventors directed their attention to the structure of softened steel wire rods or bars and discovered a novel as-hot-rolled microstructure equivalent to the one obtained through the softening.

Figure 1:
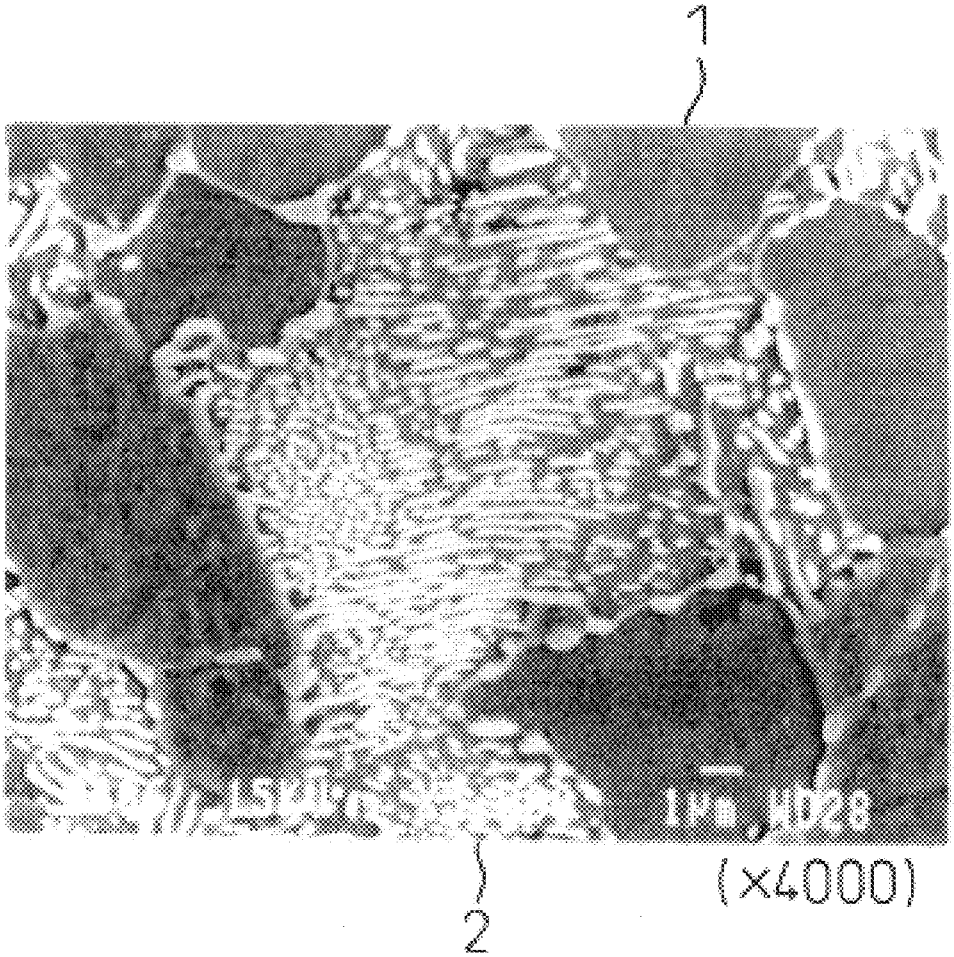
FIG. 1 is a micrograph (×4,000) of the microstructure of a hot rolled CH45K steel wire rod after a common annealing (700° C.×3 h.).

As shown in FIG. 1, the microstructure obtained through applying a common annealing (700° C.×3 h.) to a conventional hot rolled steel wire rod consists of ferrite 1 and lamellar pearlite with the lamellae (tabular cementite) of the lamellar pearlite partially divided into carbide fragments 2.

Figure 2A:
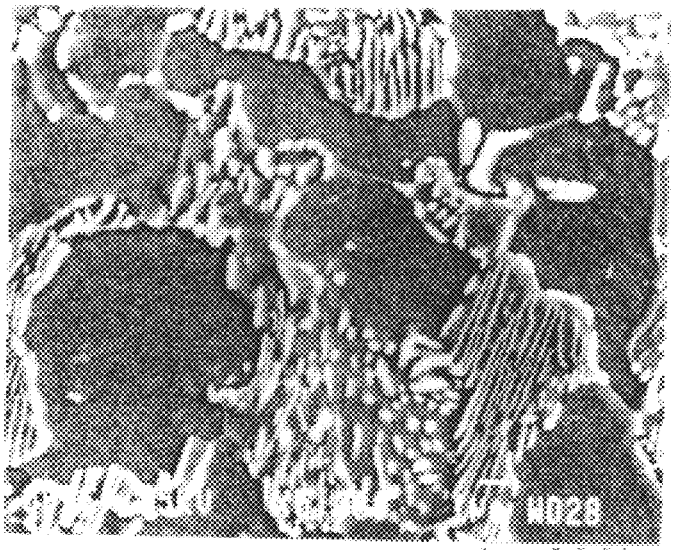
FIGS. 2 (*a*) and 2 (*b*) are micrographs (×4,000) of the microstructure of the steel wire rod according to the present invention as-hot-rolled.
Figure 2B:
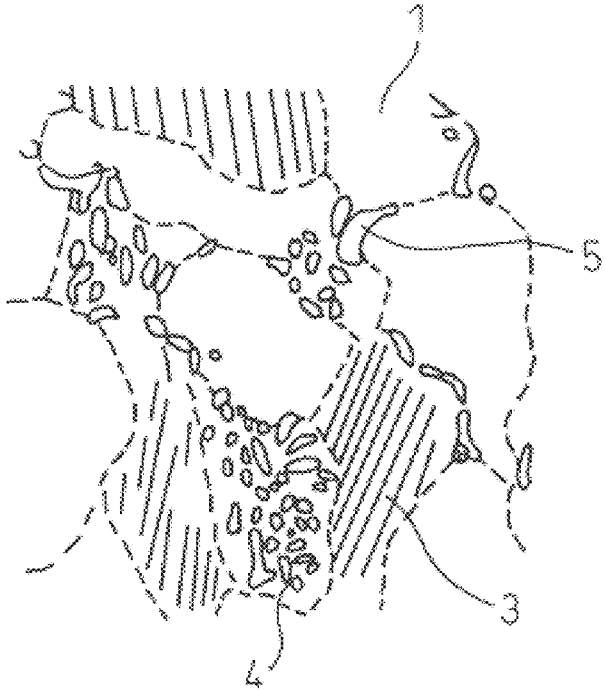

FIG. 2 (*a*) is a micrograph (×4,000) showing the microstructure of an as-hot-rolled steel wire rod according to the present invention, and FIG. 2 (*b*) a schematic illustration to explain the micrograph. As shown in FIGS. 2 (*a*) and 2 (*b*), the microstructure of the steel according to the present invention has a novel structure consisting of ferrite (α) 1 and pearlite, wherein the pearlite exists as two different kinds of pearlite, one being the lamellar pearlite 3 and the other containing granular carbide (cementite) 4 formed by the fragmentation and spheroidizing of the tabular cementite in the pearlite, and there is granular carbide (cementite) 5 precipitated at grain boundaries.

The structure according to the present invention has granular carbide and is different from the conventional structure where the lamellae are fragmented. The strength is compared hereafter for two steel wire rods having these different structures.

Figure 3:
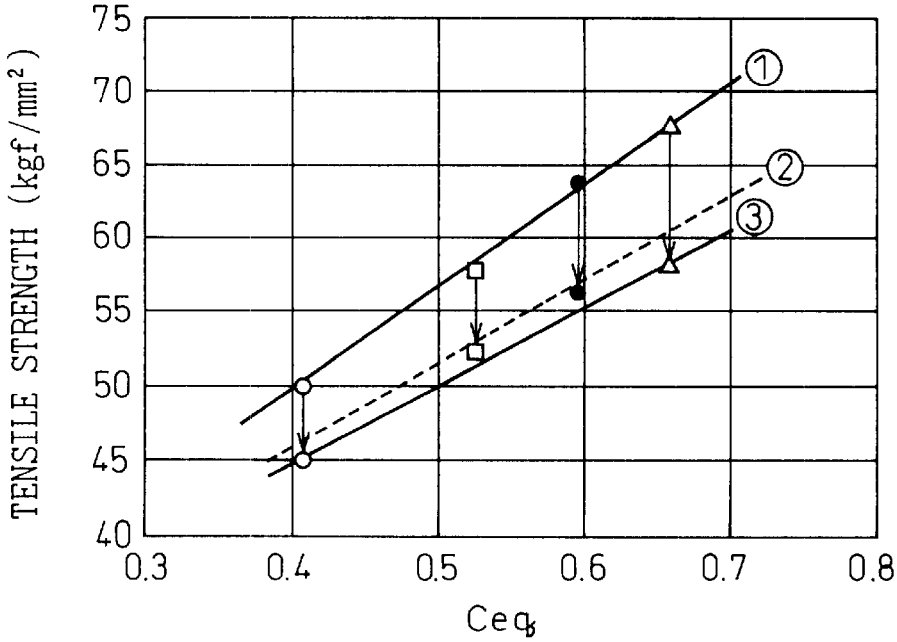
FIG. 3 is a graph comparing the strengths of a conventional steel wire rod as-hot-rolled, a steel wire rod after a common annealing and a steel wire rod according to the present invention as-hot-rolled.

FIG. 3 is a graph comparing conventional as-hot-rolled steel wire rods, steel wire rods after a common annealing and the as-hot-rolled steel wire rods according to the present invention, with regard to their strength. ① in the figure shows the strength of the conventional as-hot-rolled steel wire rods, ② that of the steel wire rods treated with a common annealing after hot rolling and ③ the same of the as-hot-rolled steel wire rods according to the present invention.

As seen in FIG. 3, the strength of the as-hot-rolled steel wire rods according to the present invention ③ is lower than that of the conventional as-hot-rolled steel wire rods ① by 10 to 15% at any carbon content from 0.25 to 0.45%, demonstrating a remarkable softening effect. This softening is nearly equal to or better than that of the steel wire rods after a common annealing ②.

To be more specific, the present invention brought about a decrease in tensile strength (softening) as follows: from 68 to 58 kgf/mm$^2$ with a 0.45% C steel (marked with Δ); from 64 to 56 kgf/mm$^2$ with a 0.40% C steel (marked with ●); from 58 to 52 kgf/mm$^2$ with a 0.35% C steel (marked with □); and from 50 to 45 kgf/mm$^2$ with a 0.25% C steel (marked with ○). In contrast to the above, the Japanese Unexamined Patent Publication No. S57-73123, for instance, discloses in the example section that the following tensile strength values are achievable; 64 kgf/mm$^2$ with a 0.43% C steel; 67.5 kgf/mm$^2$ with a 0.40% C steel; and 53.4 kgf/mm$^2$ with a 0.23% C steel. Compared with this, it is clear that the as-hot-rolled steel wire rods according to the present invention achieve a far better softening effect.

The good softening effect of the present invention is considered to result from the granular carbide (cementite) formed by spheroidizing the tabular carbide (cementite) in the lamellar pearlite besides the high percentage (54 to 88%) of ferrite.

The carbide required for obtaining the softening effect is a granular carbide 2 μm or less in circle-equivalent diameter and having an aspect ratio of 3 or less, which carbide is distinctly different from the one formed by annealing through the fragmentation of the tabular carbide.

For achieving the same degree of softening as an annealed steel wire rod, it is also necessary that ferrite crystal grains in a steel microstructure are made so fine as to have a ferrite crystal grain size number, defined under JIS G 0552, of 11 or higher. When the ferrite crystal grain size number is below 11, the granulation of cementite in pearlite is insufficient and a desired level of softening is not obtained. In addition, the granular carbide has to account for a percentage area of 3 to 15%, preferably 6 to 15%, for the softening.

Since an as-hot-rolled steel material is to be formed into machine components through cold forging using metal dies and molds, when the strength of the material is decreased (softened) by 10 kgf/mm$^2$, for instance, the service life of the tools will become 4 to 5 times longer. Thus, the as-rolled steel wire rod or bar according to the present invention can remarkably improve the service life of the metal tools.

Hereafter explained are the reasons why the chemical composition of the object steel is defined in the present invention.

C is indispensable for increasing steel strength to suit machine structural components and, with a C content less than 0.1%, the strength of final products is insufficient but, with a C content exceeding 0.5%, the toughness of the final products is deteriorated. The C content is, therefore, limited to 0.1 to 0.5%.

Si is added as a deoxidizing agent and to increase the strength of the final products through solid solution hardening. A Si content below 0.01% is insufficient for obtaining the above effects but, when it is added in excess of 0.5%, these effects are saturated and, adversely, toughness is lowered. The Si content is, therefore, limited to 0.01 to 0.5%. It has to be noted that, besides Si, Al can also be used for the deoxidation of steel. Use of Al, which is a strong deoxidizing agent, is preferable for attaining especially low oxygen content. In such a case, 0.2% or less of Al may remain in the steel, but an Al content of this level is tolerable in the present invention.

Mn is effective for increasing the strength of the final products through the enhancement of hardenability but, with a Mn content below 0.3%, a sufficient effect is not obtained and, with an addition in excess of 1.5%, the effect is saturated and, adversely, toughness is lowered. The Mn content is, therefore, limited to 0.3 to 1.5%.

S is inevitably included in steel and exists in the form of MnS. Since S contributes to the improvement of machinability and the formation of a fine crystal structure, its content of 0.1% or less is tolerable in the present invention. However, since S is detrimental to cold formability, it is preferable to limit its content to 0.035% or less when machinability is not required.

P is also inevitably included in steel, but it causes grain boundary segregation and center segregation, deteriorating toughness. It is, therefore, preferable to limit the P content of 0.035% or less.

While the fundamental chemical composition of the steel according to the present invention is as described above, the present invention further provides that one or more of Cr, Mo, Ni, Cu and B may be added. These elements are added to increase the strength of final products through the enhancement of hardenability and other effects. However, since the addition of these elements in large quantities increases hardness through the formation of bainite and martensite in the as-hot-rolled condition, besides being uneconomical, their contents are limited as follows:

0.2 to 2.0% of Cr, 0.1 to 1.0% of Mo, 0.3 to 1.5% of Ni, 1.0% or less of Cu, and 0.005% or less of B.

Further, the present invention provides that one or more of Ti, Nb and V may be added for the purpose of grain size control. The effect is, however, insufficient when the content of Ti, Nb or V is below 0.005, 0.005 or 0.03%, respectively. On the other hand, when the content exceeds 0.04, 1.0 or 0.3%, respectively, the effect is saturated and toughness is deteriorated. The contents of these elements are, therefore, limited as follows:

0.005 to 0.04% of Ti, 0.005 to 0.1% of Nb, and 0.03 to 0.3% of V.

The method to produce a steel wire rod or bar for machine structural use according to the present invention is described hereafter.

By the present invention, a steel wire rod or bar having a novel microstructure is produced through the hot rolling of billets of a steel according to any one of claims 1 to 3 at a low temperature to form fine austenite grains, and then cooling at an ultra-low cooling rate to induce ferritic and pearlitic transformation. Since the steel wire rod or bar thus obtained is softened in the as-hot-rolled condition, it can be used as a steel wire rod or bar for machine structural use having good cold workability.

According to the present invention, in the first place, a steel billet is rough hot rolled in a temperature range from 850 to below 1,000° C. and finish hot rolled in a temperature range immediately above the $Ar_3$ transformation temperature, that is from $Ar_3$ to 150° C. above it. Then, subsequent to the low temperature rolling, the rolled steel material undergoes an ultra-slow cooling at a cooling rate of 0.02 to 0.3° C./sec. from 700 to 650° C.

The reason why the rough hot rolling temperature is defined as from 850 to below 1,000° C. is that, at a temperature below 850° C., austenite grains are not made sufficiently fine but, at 1,000° C. or above, the austenite grains become coarse. The austenite grains are made fine by applying the finish hot rolling at a temperature immediately above $Ar_3$ and their grain boundaries serve as the sites for ferrite nucleation, and, thus, the ferritic transformation is accelerated and the ferrite percentage increases. Although it is preferable to conduct the finish hot rolling at a temperature immediately above $Ar_3$, it is practically difficult to maintain the temperature at immediately above $Ar_3$. For this reason, the present invention sets a tolerable upper limit at 150° C. above $Ar_3$. Note that, when the finish hot rolling temperature is below $Ar_3$, the rolling is conducted at the two-phase zone of austenite and ferrite. In such a case, a homogeneous and fine ferrite-pearlite structure is not obtained after the rolling and an unwelcome acicular ferrite-bainite structure may form locally.

Figure 4:
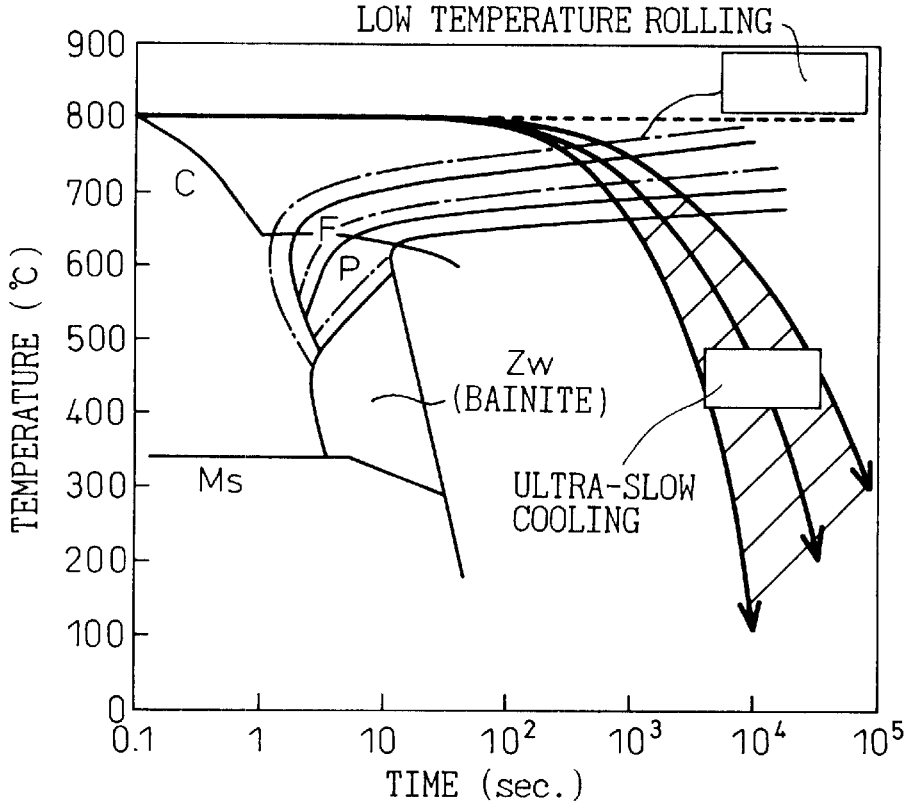
FIG. 4 is a diagram showing CCT curves.
Figure 5:
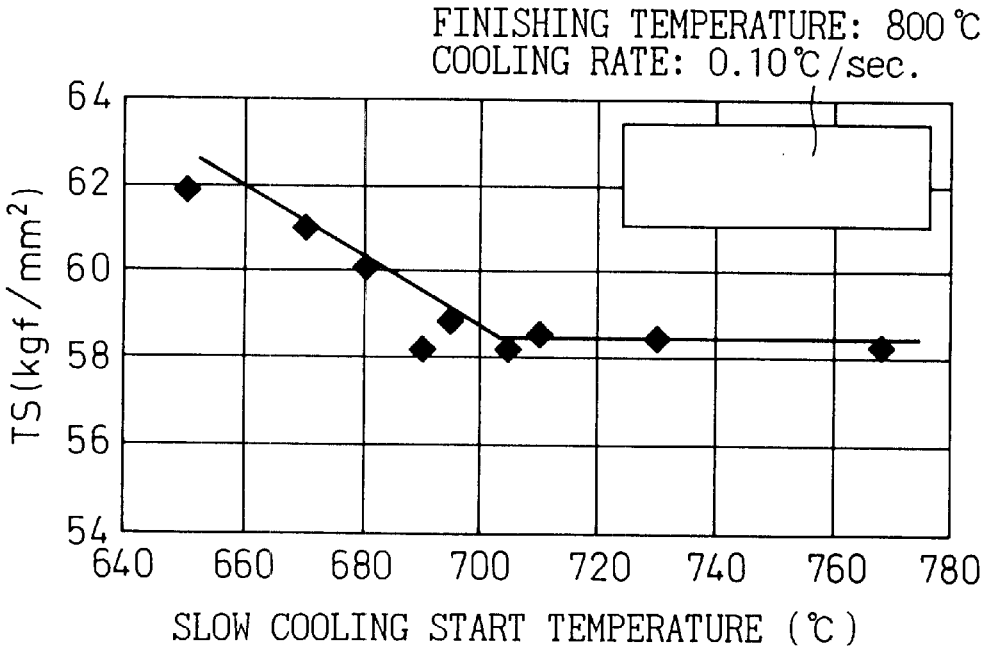
FIG. 5 is a graph showing the relationship between the temperature at the start of slow cooling and steel strength.

As is shown by the CCT curves in FIG. 4, the low temperature rolling according to the present invention causes the ferritic transformation to take place immediately and the beginning of the ferritic transformation to shift to the shorter time side as shown with the chain lines. As a result, the ferrite percentage increases. Then it so follows that the pearlitic transformation also shifts to the shorter time side, that the transformation temperature goes up and that C diffusion is accelerated. This results in the granulation of cementite and the broadening of pearlite lamella space.

Figure 6:
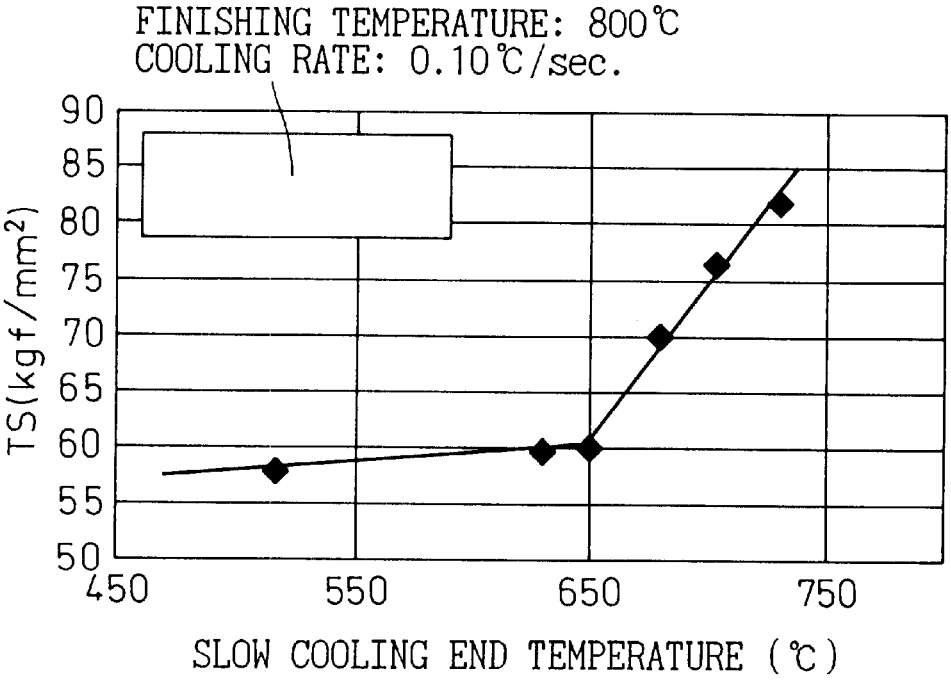
FIG. 6 is a graph showing the relationship between the temperature at the end of slow cooling and steel strength.

FIG. 6 shows the relationship between the temperature at the start of a slow cooling and steel strength. As seen in the figure, unless the slow cooling is commenced from 700° C. at the lowest, a sufficient softening effect is not achieved. On the other hand, FIG. 6 shows the relationship between the temperature at the end of a slow cooling and the steel strength. As seen here, unless the slow cooling is finished at 650° C. or above, the softening effect is not obtained.

Additionally, if the cooling rate exceeds 0.3° C./sec., any of the granulation of cementite, the broadening of the pearlite lamella space and the increase in the ferrite percentage is not achieved sufficiently. If the cooling rate does not reach 0.2° C./sec., on the other hand, the cooling time becomes too long to be economical.

For the reasons described above, the present invention stipulates that the cooling has to be conducted from 700 to 650° C. at a cooling rate of 0.02 to 0.3° C./sec. Hot water (20 to 99° C.) or an air blast may be used for the cooling.

EXAMPLE 1

The present invention is explained more specifically hereafter based on examples.

Table 1 shows the chemical compositions of specimens. All the specimens were produced by continuous casting after refined in a converter, then cast blooms were broken down into billets 162 mm×162 mm in section and then the billets were rolled into wire rods 11 mm in diameter under the conditions listed in Table 2. The specimens of rolling No. I according to the present invention were rough hot rolled at 900° C. and finish hot rolled at 750° C., well within the temperature range between $Ar_3$ and 150° C. above it, and then underwent a controlled cooling on a transfer line covered with a slow cooling cover and, after being reformed into tight coils, in a slow cooling furnace. The materials of rolling No. II, which were comparative specimens, were rough hot rolled at 1,050° C., finish hot rolled at 900° C., then underwent a controlled cooling on a coil transfer line covered with a slow cooling cover. The comparative specimens of rolling No. II were softened thereafter by holding at 700° C. for 3 h. and then leaving to cool naturally.

Tensile strength of the specimens was evaluated as an indicator of cold workability. With regard to structural characteristics of the specimens, their microstructure, the ferrite percentage, the ferrite crystal grain size number and the percentage area of the granular carbide were evaluated. The evaluation items of the specimens according to the present invention and the comparative specimens are compared in Table 3. As is clear in the table, whereas the granular carbide is little seen in the as-rolled comparative specimens of rolling No. II, the specimens according to the present invention contain much granular carbide, their ferrite percentages are higher than those of the comparative specimens of rolling No. II by about 5%, and their tensile strengths are lower (softer) than those of the comparative specimens by about 100 MPa or more. As a result, it was confirmed that the specimens according to the present invention achieve the same level of softening as the comparative specimens of rolling No. II (by conventional methods) which underwent a softening treatment after rolling.

TABLE 1

| Steel No. | C | Si | Mn | P | S | Cr | Mo | Al | Ni | Cu | B | Ti | Nb | (wt %) V |
|---|---|---|---|---|---|---|---|---|---|---|---|---|---|---|
| A | 0.44 | 0.23 | 0.78 | 0.014 | 0.025 | 0.05 | — | 0.023 | — | — | — | — | — | — |
| B | 0.40 | 0.24 | 0.68 | 0.011 | 0.010 | — | — | 0.025 | — | — | — | — | — | — |
| C | 0.35 | 0.25 | 0.70 | 0.013 | 0.008 | — | — | 0.025 | — | — | — | — | — | — |
| D | 0.25 | 0.23 | 0.71 | 0.012 | 0.010 | — | — | 0.024 | — | — | — | — | — | — |
| E | 0.40 | 0.25 | 0.77 | 0.020 | 0.020 | 1.02 | — | 0.032 | — | — | — | — | — | — |
| F | 0.35 | 0.19 | 0.80 | 0.015 | 0.022 | 1.00 | 0.18 | 0.033 | — | — | — | — | — | — |
| G | 0.15 | 0.20 | 0.55 | 0.013 | 0.022 | 0.55 | 0.17 | 0.029 | 0.55 | — | — | — | — | — |
| H | 0.25 | 0.26 | 0.35 | 0.010 | 0.009 | — | — | 0.030 | — | — | 0.0018 | 0.02 | — | — |
| I | 0.45 | 0.04 | 0.35 | 0.014 | 0.006 | — | — | 0.020 | — | — | 0.0020 | 0.02 | — | — |
| J | 0.25 | 0.20 | 0.35 | 0.008 | 0.008 | — | — | 0.035 | — | 0.20 | 0.0016 | 0.04 | — | — |
| K | 0.24 | 0.23 | 0.34 | 0.010 | 0.015 | — | — | 0.030 | — | — | 0.0020 | 0.02 | 0.05 | — |
| L | 0.25 | 0.25 | 0.37 | 0.011 | 0.014 | — | — | 0.025 | — | — | 0.0025 | 0.02 | — | 0.10 |

TABLE 2

| Classification | Rolling no. | Rolled diameter (mm) | Rough rolling temperature (° C.) | Finish rolling temperature (° C.) | Average cooling rate from 700 to 650° C. (° C./sec) | Softening after rolling |
|---|---|---|---|---|---|---|
| Inventive specimen | I | 11 | 900 | 750 | 0.10 | No applied |
| Comparative specimen | II | 11 | 1050 | 900 | 0.50 | Applied (700° C. × 3 h.) |

TABLE 3

| | | | | As-rolled material | | | | | |
|---|---|---|---|---|---|---|---|---|---|
| Classification | Symbol | Steel No. | Rolling no. | Tensile strength (MPa) | Microstructure | Ferrite percentage | Ferrite grain size number | Percentage area of granular carbide | Softened material Tensile strength (MPa) |
| Inventive specimen | 1 | A | I | 591 | F + P + Gr. C | 68 | 11.5 | 10 | — |
| Comparative specimen | 2 | " | II | 704 | F + P | 48 | 8.7 | 0 | 602 |
| Inventive specimen | 3 | B | I | 571 | F + P + Gr. C | 72 | 11.2 | 8 | — |
| Comparative specimen | 4 | " | II | 653 | F + P | 52 | 8.5 | 0 | 581 |
| Inventive specimen | 5 | C | I | 530 | F + P + Gr. C | 76 | 11.2 | 7 | — |
| Comparative specimen | 6 | " | II | 591 | F + P | 58 | 8.5 | 0 | 540 |
| Inventive specimen | 7 | D | I | 459 | F + P + Gr. C | 88 | 11.3 | 6 | — |
| Comparative specimen | 8 | " | II | 510 | F + P | 67 | 8.6 | 0 | 469 |
| Inventive specimen | 9 | E | I | 695 | F + P + Gr. C | 54 | 11.2 | 8 | — |
| Comparative specimen | 10 | " | II | 748 | F + P + Zw | 45 | 8.5 | 0 | 680 |
| Inventive specimen | 11 | F | I | 632 | F + P + Gr. C | 55 | 11.7 | 5 | — |
| Comparative specimen | 12 | " | II | 734 | F + P + Zw | 45 | 8.6 | 0 | 622 |
| Inventive specimen | 13 | G | I | 578 | F + P + Gr. C | 75 | 11.7 | 7 | — |
| Comparative specimen | 14 | " | II | 748 | F + P + Zw | 50 | 8.5 | 0 | 578 |
| Inventive specimen | 15 | H | I | 544 | F + P + Gr. C | 86 | 11.2 | 6 | — |
| Comparative specimen | 16 | " | II | 646 | F + P | 65 | 8.3 | 0 | 540 |
| Inventive specimen | 17 | I | I | 469 | F + P + Gr. C | 75 | 11.1 | 8 | — |
| Comparative specimen | 18 | " | II | 571 | F + P | 55 | 8.5 | 0 | 479 |
| Inventive specimen | 19 | J | I | 544 | F + P + Gr. C | 85 | 11.5 | 7 | — |
| Comparative specimen | 20 | " | II | 662 | F + P | 65 | 8.9 | 0 | 551 |
| Inventive specimen | 21 | K | I | 544 | F + P + Gr. C | 85 | 12.1 | 7 | — |

TABLE 3-continued

| Classification | Symbol | Steel No. | Rolling no. | As-rolled material Tensile strength (MPa) | Microstructure | Ferrite percentage | Ferrite grain size number | Percentage area of granular carbide | Softened material Tensile strength (MPa) |
|---|---|---|---|---|---|---|---|---|---|
| Comparative specimen | 22 | " | II | 662 | F + P | 64 | 8.8 | 0 | 551 |
| Inventive specimen | 23 | L | I | 595 | F + P + Gr. C | 84 | 11.9 | 8 | — |
| Comparative specimen | 24 | " | II | 713 | F + P | 62 | 8.9 | 0 | 602 |

F: ferrite;
P: pearlite;
Zw: bainite;
Gr. C: granular carbide

As explained hereinbefore, a hot rolled steel wire rod or bar for machine structural use according to the present invention is soft in the as-hot-rolled state without an annealing for softening, and its softness is equal to or better than that of conventional softened wire rods or bars. The present invention, therefore, has the effects to enhance productivity, save energy and remarkably prolong the service life of the metal tools used for cold working, since the steel wire rod or bar according to the present invention, unlike the conventional wire rods or bars, does not require an annealing treatment for softening before cold working.

What is claimed is:

1. A hot rolled steel wire rod or bar for machine structural use, characterized in that: the wire rod or bar is made from a steel consisting essentially of, in weight, 0.1 to 0.5% of C, 0.01 to 0.5% of Si, 0.3 to 1.5% of Mn, and the balance consisting of Fe and unavoidable impurities; its microstructure consists of ferrite and pearlite; its ferrite crystal grain size number defined under Japanese Industrial Standard (JIS) G 0552 is 11 or higher; and a granular carbide 2 $\mu$m or less in circle-equivalent diameter and having an aspect ratio of 3 or less accounts for a percentage area of 3 to 15%.

2. A hot rolled steel wire rod or bar for machine structural use according to claim 1, characterized by further containing, in weight, one or more of;

0.2 to 2.0% of Cr, 0.1 to 1.0% of Mo, 0.3 to 1.5% of Ni, 1.0% or less of Cu, and 0.005% or less of B.

3. A hot rolled steel wire rod or bar for machine structural use according to claim 1, characterized by further containing, in weight, one or more of;

0.005 to 0.04% of Ti, 0.005 to 0.1% of Nb, and 0.03 to 0.3% of V.

4. A method to produce a hot rolled steel wire rod or bar for machine structural use, characterized by subjecting a steel having the chemical composition specified in any one of claims 1 to a rough hot rolling in a temperature range from 850 to below 1,000° C., a finish hot rolling in a temperature range from the $Ar_3$ transformation temperature to 150° C. above it and a cooling from 700 to 650° C. at a cooling rate of 0.02 to 0.3° C./sec., so that the steel may have a ferrite crystal grain size number defined under JIS G 0552 being 11 or higher and contain a granular carbide 2 $\mu$m or less in circle-equivalent diameter and having an aspect ratio of 3 or less accounting for a percentage area of 3 to 15%.

* * * * *

UNITED STATES PATENT AND TRADEMARK OFFICE

CERTIFICATE OF CORRECTION

PATENT NO. : 6,551,419 B2
DATED : April 22, 2003
INVENTOR(S) : Hideo Kanisawa et al.

It is certified that error appears in the above-identified patent and that said Letters Patent is hereby corrected as shown below:

Title page,
Item [22], change "Jul. 6, 2001" to -- April 10, 2001 --.

Signed and Sealed this

Fourteenth Day of October, 2003

JAMES E. ROGAN
*Director of the United States Patent and Trademark Office*